United States Patent [19]

Hastings

[11] 4,164,224

[45] Aug. 14, 1979

[54] DISPOSABLE EARLOBE PIERCING DEVICE AND METHOD FOR USING THE SAME

[76] Inventor: John A. Hastings, 31 Main St., Bass River, Mass. 02664

[21] Appl. No.: 759,384

[22] Filed: Jan. 14, 1977

Related U.S. Application Data

[63] Continuation-in-part of Ser. No. 553,671, Feb. 27, 1975, abandoned, which is a continuation-in-part of Ser. No. 457,551, Apr. 13, 1974, abandoned.

[51] Int. Cl.[2] ..... A61B 17/00

[52] U.S. Cl. ..... 128/330; 128/1 R

[58] Field of Search ..... 128/330, 329 R, 329 A, 128/1 R

[56] References Cited

U.S. PATENT DOCUMENTS

| | | | |
|---|---|---|---|
| 3,187,751 | 6/1965 | Coren et al. | 128/330 |
| 3,608,946 | 9/1971 | Erickson | 294/64 |
| 3,641,804 | 2/1972 | Oudenhoven | 72/409 |
| 3,901,243 | 8/1975 | Read | 128/329 R |
| 3,943,935 | 3/1976 | Cameron | 128/330 |

FOREIGN PATENT DOCUMENTS

| | | | |
|---|---|---|---|
| 2597 | of 1903 | United Kingdom | 128/330 |

*Primary Examiner*—Robert W. Michell
*Assistant Examiner*—Michael H. Thaler
*Attorney, Agent, or Firm*—Wolf, Greenfield & Sacks

[57] ABSTRACT

A disposable ear piercing device is prepackaged in a sterile condition and is ready for immediate use. The device includes a pair of spaced jaws which receive the earlobe therebetween. One jaw is preloaded and carries a piercing pin and the other jaw is preloaded with and carries a lock nut. The jaws are squeezed toward each other in a manner which first causes the earlobe to be gripped and then causes a drive member carried by the first jaw to rupture when the jaws are squeezed under a predetermined force and to transfer the squeezing force directly to the pin to drive it through the earlobe and into the lock nut.

60 Claims, 24 Drawing Figures

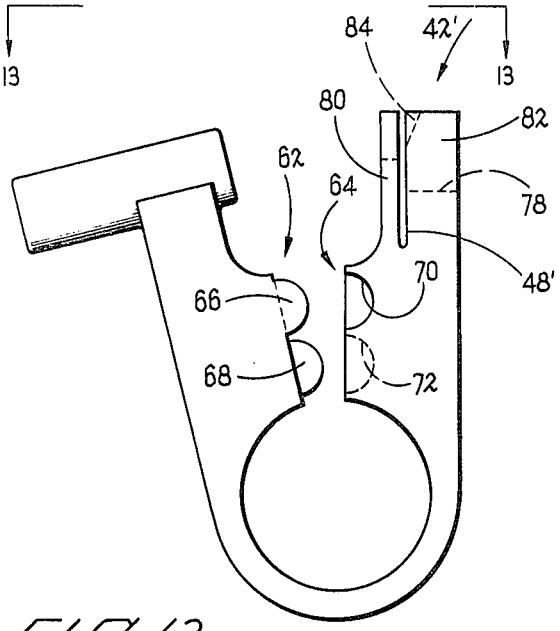
FIG. 12
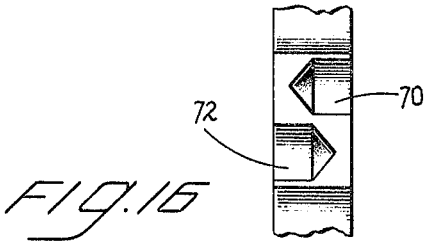
FIG. 16
FIG. 13
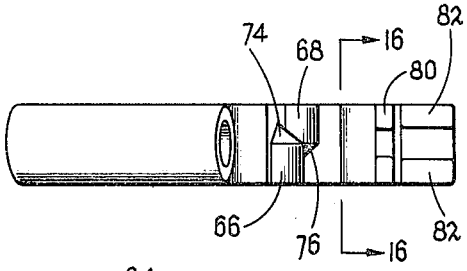
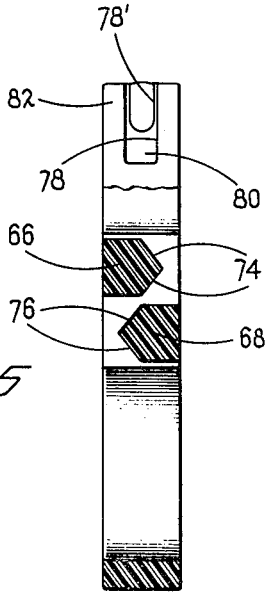
FIG. 15
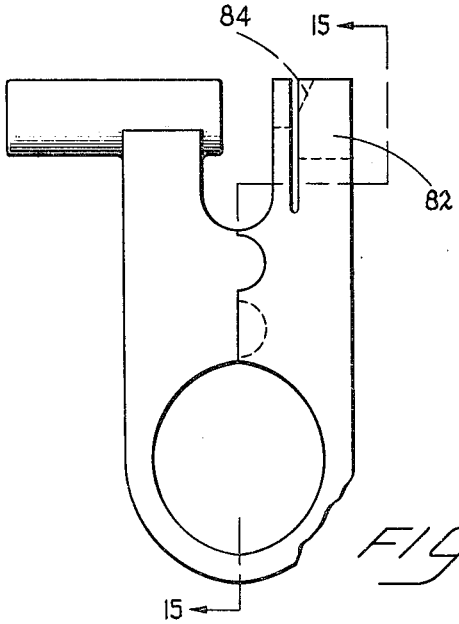
FIG. 14
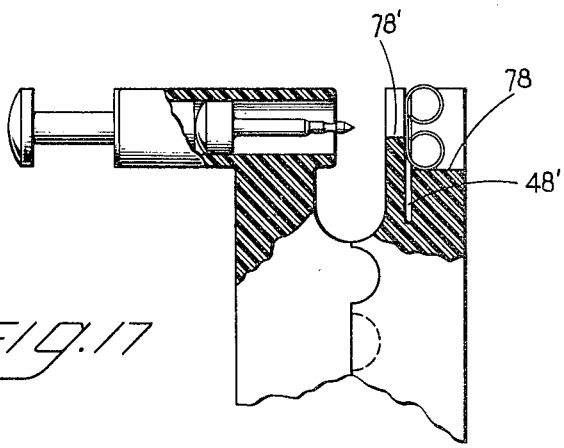
FIG. 17

DISPOSABLE EARLOBE PIERCING DEVICE AND METHOD FOR USING THE SAME

RELATED APPLICATIONS

This is a continuation-in-part of Application Ser. No. 553,671 filed Feb. 27, 1975 now abandoned which is a continuation in part of Ser. No. 457,551, filed Apr. 13, 1974, now abandoned.

BACKGROUND OF THE INVENTION

Various devices and techniques have been proposed for piercing of earlobes. In general the surgical procedure of earlobe piercing has been implemented by the use of specially designed surgical instruments such as, for example, the type shown in U.S. Pat. No. 3,187,751. Such instruments typically are employed to grip the earlobe and drive a piercing pin through the earlobe. The pin typically must be loaded into the instrument as a preliminary step. Proper procedure usually requires also that the surgical instrument and pin be autoclaved or otherwise sterilized before use. My invention relates to an improved preloaded, presterilized, disposable ear piercing device which is of low cost and is intended for a single use, thus shortening the time required to perform the procedure by eliminating the steps of autoclaving and loading the device.

SUMMARY OF THE INVENTION

In brief, the invention includes a pair of spaced jaws movable toward each other to a more closely spaced, although not fully closed, configuration to receive and firmly grip an earlobe therebetween. One of the jaws includes means for supporting a headed piercing pin and the other jaw includes means for supporting a lock nut in alignment with the piercing pin so that the tip of the pin may be secured to the nut after the pin has pierced the earlobe. Means are provided in association with the pin carrying jaw by which the open jaws may be squeezed together to their more closed configuration and in which the continued subsequent application of further squeezing pressure will cause a portion of the pin driving means to fracture to instantaneously transfer the full squeezing force directly to the head end of the pin. The fracturing takes place instantaneously so that the pin is driven immediately and quickly through the earlobe. The device then may be released, to free the combined pin and nut so that the device may be withdrawn from the earlobe leaving the pin secured thereto. The fracturing of the drive means precludes subsequent use of the device. The device may be preloaded with the pin and nut and prepackaged in a sterilized condition so that it is ready for immediate use when desired.

It is among the objects of the invention to provide an improved ear piercing device of low cost which is suitable for disposable one-time use.

Another object of the invention is to provide a prepackaged, presterilized ear piercing pin and nut and an instrument for use therewith which can be presterilized and stored in a sterile condition until use.

Another object of the invention is to provide an ear piercing device of the type described which is self-destructable upon use, thus insuring that it may not be reused.

Another object of the invention is to provide an improved ear piercing device which is easy to align with a selected location on an earlobe.

Still another object of the invention is to provide an ear piercing device of the type described which is of extremely simple construction.

DESCRIPTION OF THE DRAWINGS

The foregoing and other objects and advantages will be understood more fully from the following further description thereof, with reference to the accompanying drawings wherein:

FIG. 12 is a side elevation of the invention showing a number of further modifications;

FIG. 13 is a plan view of the device seen along the line 13—13 of FIG. 12;

FIG. 14 is a side elevation of the device shown in FIG. 12 with the jaws in their most closed position;

FIG. 15 is an illustration of the device as seen along the lines 15—15 of FIG. 14;

FIG. 16 is an illustration of the sockets in one of the abutting pads as seen along the line 16—16 of FIG. 13;

FIG. 17 is a partly broken away elevation of the device, with its jaws closed and loaded;

DESCRIPTION OF THE PREFERRED EMBODIMENT

Figure 1:
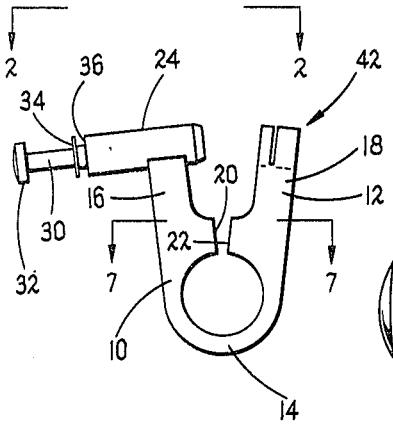
FIG. 1 is a side elevation of the ear piercing device.
Figure 2:
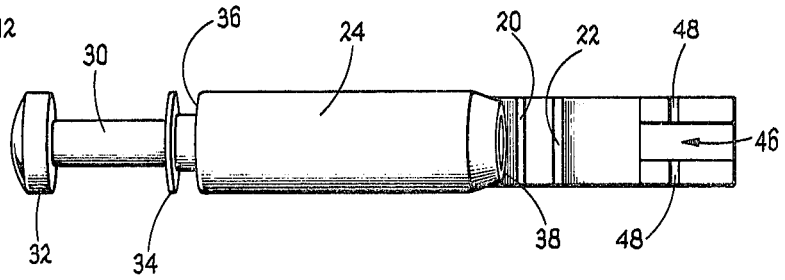
FIG. 2 is an enlarged top view of the device as seen from the line 2—2 of FIG. 1.
Figure 3:
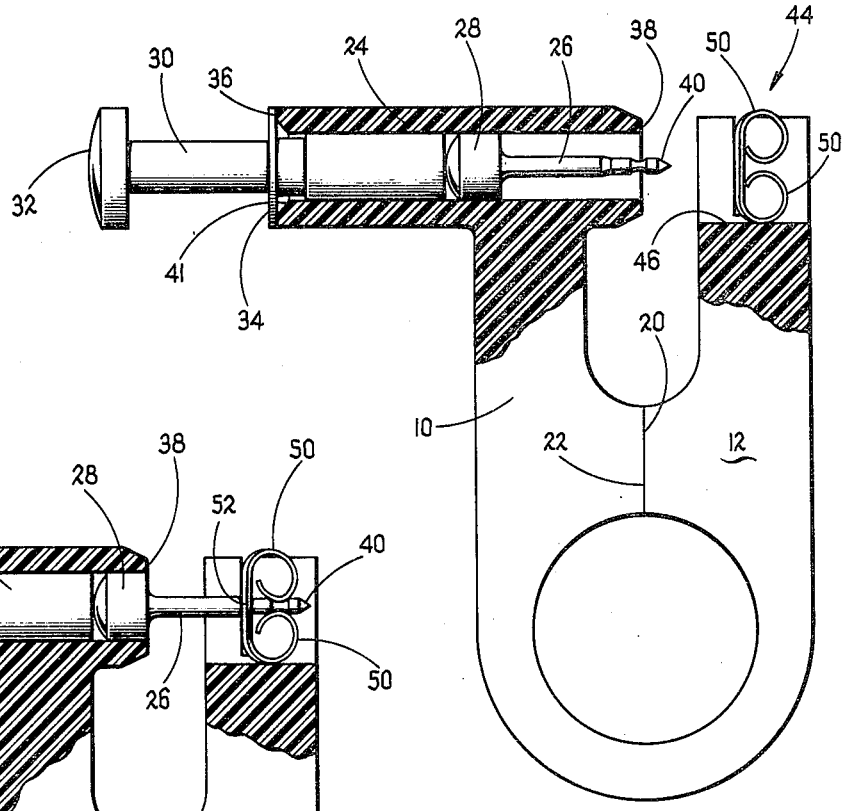
FIG. 3 is an enlarged side elevation of the device, loaded with a pin and nut and partly broken away, with the jaws in their most closed position and in readiness to drive the piercing pin.
Figure 4:
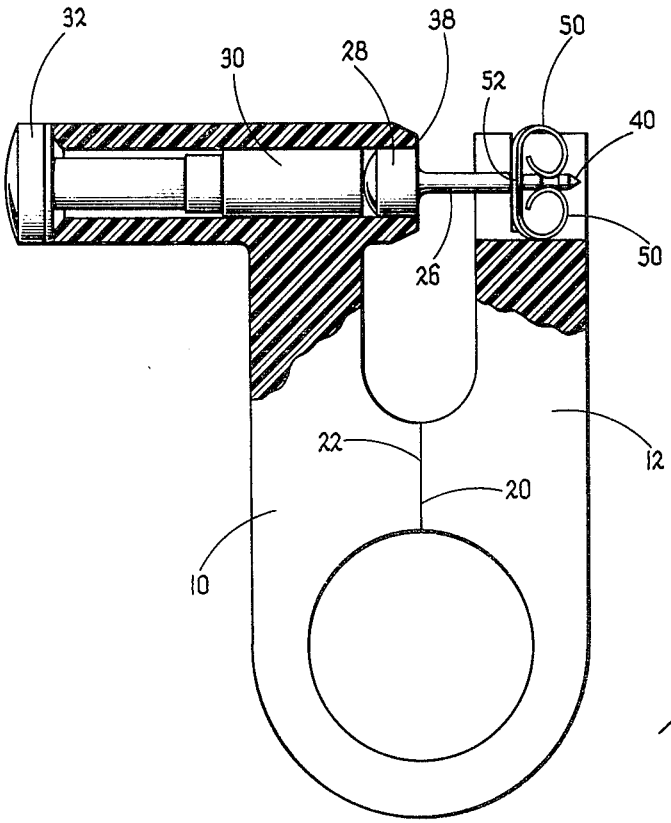
FIG. 4 is an illustration similar to FIG. 3 showing the device after the piercing pin has been driven.

As shown in FIGS. 1 and 2, the illustrative embodiment of the device includes a generally U-shaped member including a pair of legs 10, 12 joined at a bight 14, the upper ends of the legs 10, 12 being considered as jaws 16, 18 respectively. The device is fabricated from a single piece of material, preferably a flexible transparent plastic and the bight region 14 is of sufficient dimensions to enable the legs 10, 12 and their jaws 16, 18 to be flexed toward each other from the relaxed configuration shown in FIG. 1 to the closed configuration shown in FIG. 3. The bight 14 is sufficiently resilient so that when the squeezed legs are released, they will return to their relaxed configuration. Means are provided for limiting the extent to which the jaws 16, 18 may be closed, such as the inclusion of abutting pads 20, 22 on each of the legs which face inwardly toward each other and preclude jaw closure beyond a predetermined amount as described below.

Secured to the upper end of the jaw 16 is a pin carrying device which may take the form of a hollow barrel 24 which is receptive to a headed piercing pin 26. The internal dimensions of barrel 24 are such that the pin 26 may be held in place within the barrel, by engagement with the periphery of the head 28 of the pin but under a sufficiently light force which can be easily overcome so that the pin can be driven along and through the barrel 24 as described herein. By way of example the device may be made so that the pin will advance through the barrel under a force of the order of a few ounces.

The pin carrying and driving mechanism also includes a plunger 30 having a forward end which is received slidably in the rearward end of the bore of the barrel 24. An enlarged knob 32 may be formed at the rearwardly protruding end of the plunger 30. The plunger 30 also is preferably formed from a single piece of plastic material. It includes a thin circumferential collar 34 formed integrally therewith and between the ends of the plunger 30. The collar extends radially outwardly from the plunger so that it will engage the rearward surface 36 of the barrel 24 and preclude further passage of the plunger 30 through the barrel 24 except as described more fully below. The collar 34 is located longitudinally on the plunger 30 in relation to the length of the piercing pin 26 and the location of the forwardmost end 38 of the barrel 24 so that when the collar 34 is in engagement with the rear surface 36 of the barrel and the forwardmost end of the plunger 30 is in contact with the rear end of the head 28 of the pin, the piercing point 40 of the pin will protrude slightly beyond the forward end 38 of the barrel 24 as suggested in FIG. 3. By way of example, the piercing tip of the pin 26 may protrude approximately one-sixteenth of an inch beyond the forward end 38 of the barrel 24. It is desirable to fabricate the plunger 30, collar 34 and rearward end 36 of the barrel 24 so that the rear end of the barrel engages the outermost regions of the collar and provides little or no support for the innermost collar region, where it joins the plunger. This may be achieved by reducing the diameter of the plunger 30 where it joins the collar and/or chamfering the rearward end 36 of the barrel 24 as suggested at 41 in FIG. 8. This increases the stress applied at the juncture of the collar and plunger.

Figure 5:
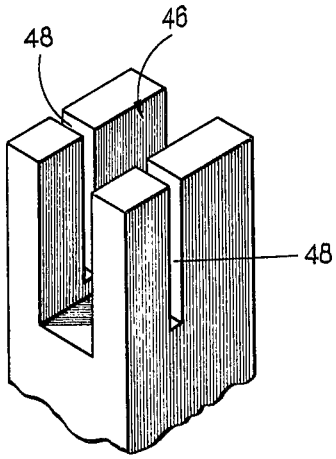
FIG. 5 is an enlarged illustration of the nut-carrying chuck.

The other of the jaws 18 is formed to define a chuck, indicated generally by the reference character 42, which is adapted to receive and retain the lock nut 44. One embodiment of the chuck 42, shown more clearly in FIG. 5 is defined by a longitudinal slot 46 and a transverse, intersecting slot 48 which receive, respectively, the curled fingers 50 and the side flanges 52 of the lock nut 44 as shown. The slots 46, 48 are dimensioned with respect to the portions of the lock nut which they receive so that the lock nut may be held lightly therein so that it will remain in the chuck until it is withdrawn after the piercing operation. The bottom of the longitudinal slot 46 is positioned longitudinally of the leg 12 so that it will position the nut in axial alignment with the pin, thus enabling the piercing point 40 of the pin to be driven through the central hole in the lock nut and be locked thereto by engagement of the end of the pin with the curled fingers 50.

In use, the loaded device is held in a relaxed configuration with its jaws being spread to receive an earlobe. The earlobe, which typically has been marked to highlight the intended piercing location then is aligned with the forwardly protruding piercing point 40 of the pin 26. The device, being gripped between the user's thumb and forefinger with his thumb bearing against the knob 32 of the plunger 30, then is squeezed to grip the earlobe firmly. The legs 10, 12 of the device are drawn together until the pads 20, 22 abut each other which precludes further closure of the jaws. It may be noted that the chuck 42 and forward end 38 of the barrel 24 will then be in their most closed position (FIG. 3), although still being spaced for example, approximately three-sixteenths of an inch. When closed thus far the piercing point 40 depresses the relatively soft ear lobe without piercing the skin.

The material and dimensions of the bight portion 14 preferably are selected in relation to the other dimensions of the device as to require a squeezing force of approximately one pound in order to bring the abutting surfaces 20, 22 together. The collar 34 is sufficiently strong to withstand a one pound closure force without fracturing to enable complete closure of the abutting surfaces 20, 22. The fracture strength of the collar also is such that an increase to a predetermined magnitude in the force which is applied to the collar of (for example, three to four additional pounds) will cause the collar 34 to rupture and separate from the plunger 30 which instantaneously shifts the force from the plunger to the rear end of the pin head 28 which drives the pin instantaneously through the barrel 24, piercing the earlobe and into locking engagement with the locking nut. The grip on the device then may be released to enable it to return to its relaxed configuration under the spring influence of the bight portion 14. The parts of the device are dimensioned so that when released, the forward end 38 of the barrel 24 will be withdrawn rearwardly from the pin head 28. The device then may be removed from the earlobe by simply withdrawing it downwardly from the earlobe to cause the lock nut 44 to be withdrawn from the slots 46, 48.

Figure 6:
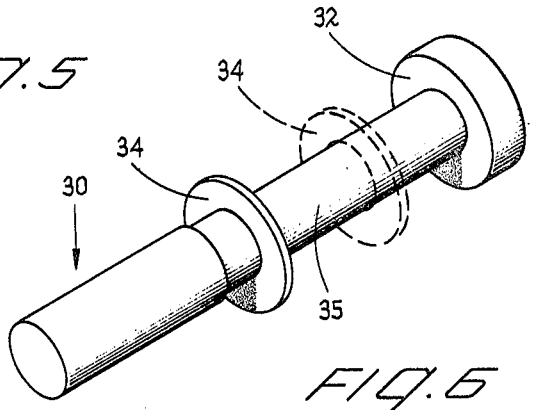
FIG. 6 is an enlarged illustration of the plunger and showing in phantom the manner in which its fracturable collar separates from the plunger.

FIG. 6 shows the manner in which the collar 34 fractures and separates from the plunger 30. The collar engages the rear surface 36 of the barrel uniformly, and preferably about its peripheral margin, which causes the stress concentration to be applied to the collar at its juncture with the plunger. The collar tends to fracture cleanly at this juncture and separates as a complete ring. The portion 35 of the plunger 30, which extends between the attached collar 34 and the plunger head 32, may be of reduced diameter which is less than the inner diameter of the separated collar so that it will not interfere with forward movement of the plunger 30.

Figure 7:
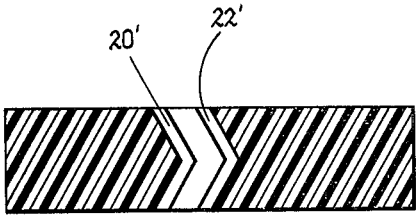
FIG. 7 is an enlarged sectional view of a modified form of the invention as seen along the line 7—7 of FIG. 1.

FIG. 7 shows an alternate form of abutting surfaces 20′, 22′ which, instead of being flat as described above are of convex and concave shape respectively. This configuration insures that when the surface 20′, 22′ are brought together, they will be in proper alignment when closed which, in turn, insures that the pin 26 will be in precise alignment with the hole in the lock nut 44. The convex, concave configuration of the surfaces 20', 22' may take any of a variety of shapes although the V-shape configurations shown are preferred. It may be noted that any tendency for misalignment will be in the lateral direction and for this reason the illustrated configuration of mating surfaces 20', 22' are shown only as being employed to insure proper lateral alignment.

Figure 9:
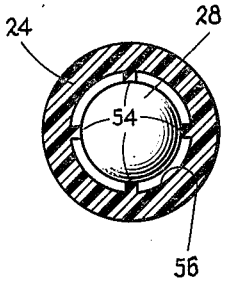
FIG. 9 is a sectional illustration as seen along the line 9—9 of FIG. 8.
Figure 8:
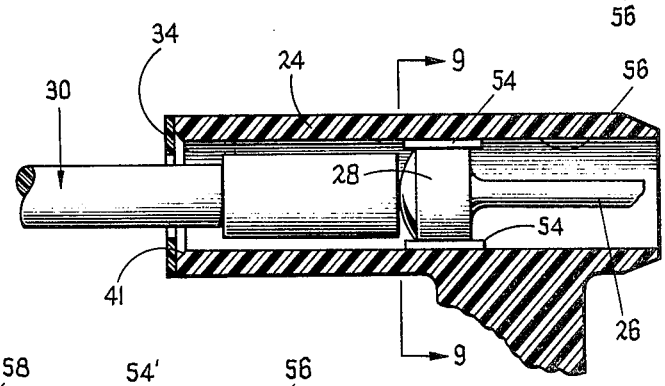
FIG. 8 is a sectional elevation of the device taken through the pin carrying and drive means and showing a further modification of the invention.
Figure 10:
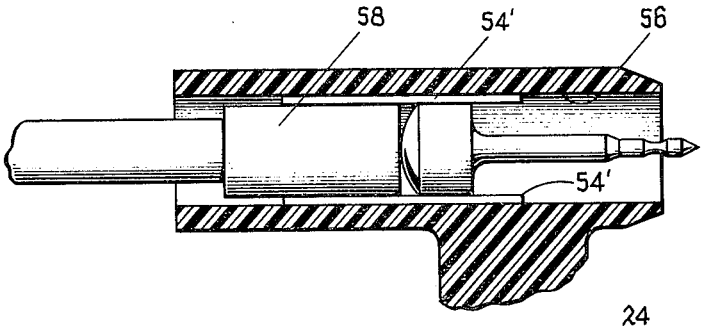
FIG. 10 is a sectional elevation of the pin carrying and drive means showing a further embodiment of the invention.

As described above, the pin 26 is retained in a snug, but slidable fit within the barrel 24. This may be achieved by a variety of configurations such as the one discussed above in which the bore of the barrel is fabricated to close tolerances with respect to the periphery of the pin head. FIGS. 8 and 9 show an alternate technique in which longitudinal ribs 54 are formed, and in circumferentially spaced relation along the bore 56 of the barrel. The ribs may define an inner circumference slightly smaller than that defined by the external circumference of the pin head 28 while the main internal diameter of the barrel bore 56 is larger than that of the pin head 28. The ribs 54 preferably are narrow and should be sufficiently dimensioned to require approximately a few ounces of axial thrust on the pin to advance the pin past the ribs. It may be noted that the ribs 54 need not extend fully along the length of the bore 56 but may be limited in length, as long as they engage and hold the pin head within the bore. As shown in FIG. 10 the ribs 54' may be extended rearwardly in the bore 56 so that they may also engage the forward most inner end 58 of the plunger 30 to also retain it in place in the preassembled device. When this latter configuration is employed it is desirable that the various parts be dimensioned and designed so that it will take less force to drive the plunger through the bore than that required for the pin.

In still another modification of the invention, manufacturing tolerances in the fit of the pin head, bore and plunger may be relaxed and these parts may be retained together by a nonreactive grease.

Figure 11:
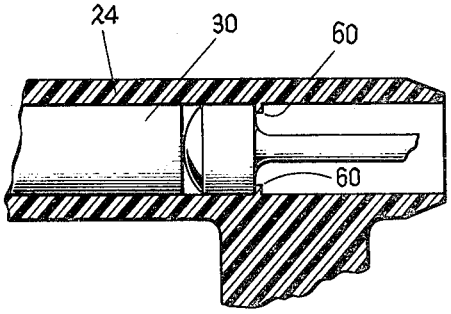
FIG. 11 is a sectional elevation of the pin carrying and drive means showing a modified form of the pin driving mechanism.
Figure 18:
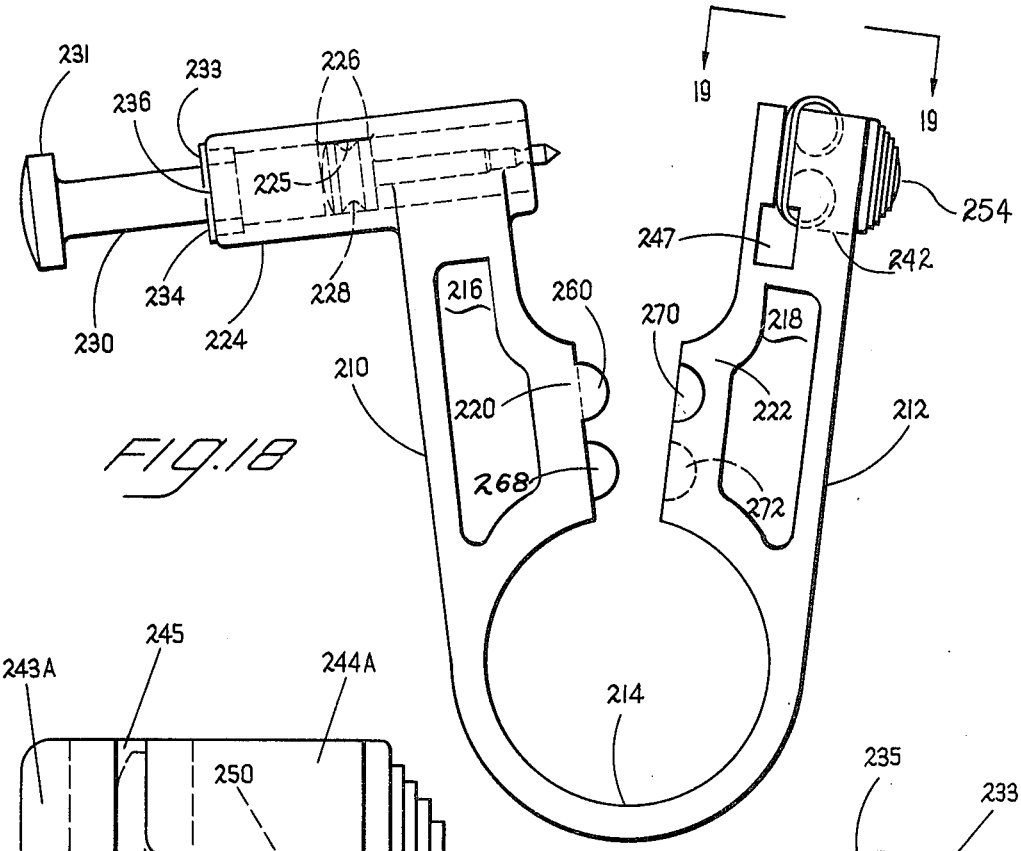
FIG. 18 is an enlarged elevational view in partial cross section of the preferred form of the invention, shown loaded with a pin and nut.
Figure 19:
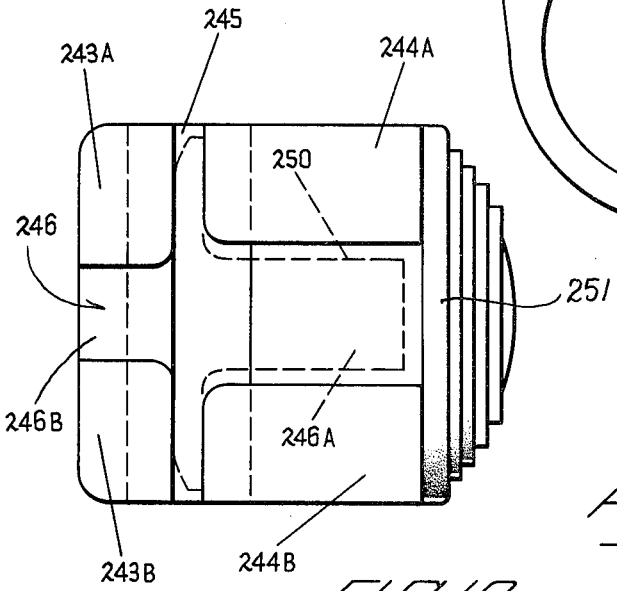
FIG. 19 is a view taken along the line 19—19 of FIG. 18.
Figure 21:
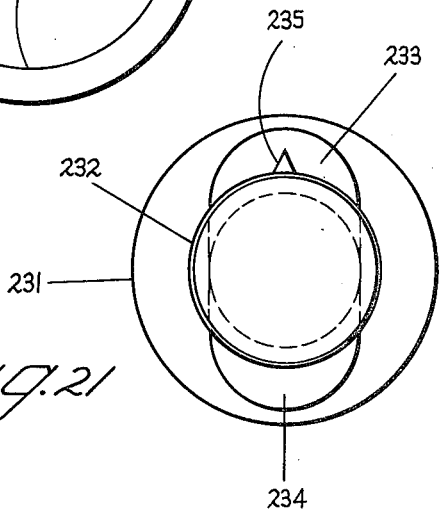
FIG. 21 is an end view of the plunger.

FIG. 11 shows an alternate construction for the rupturable member of the pin driving mechanism. In this embodiment, the barrel 24 includes one or more internal projections 60 which extend into the bore to obstruct the passage of the forward end of the pin head 28. The obstructions 60 are of dimension and design as to retain the pin while the jaws of the device are closing and to thereafter fracture when sufficient axial force is exerted on the plunger to thereby free immediately the pin for movement and enable the axial force of the plunger to drive the pin through the earlobe. The projection may take a variety of configurations such as a thin circular flange or one or more individual projections. In this embodiment the plunger does not have the fracturable collar 34 as it is not needed.

FIGS. 12–17 show still further modifications which may be employed in the invention. The abutting surfaces may be formed by providing one of the abutting pads 62 with a pair of projections 66, 68 and the other pad 64 with a pair of sockets 70, 72 receptive to the projections. The projections may be spaced heightwise of each other and as shown in FIG. 15 are also spaced laterally of each other. The inwardly extending surfaces 74, 76 of each of the projections defines an inclined configuration which, when they mate with the corresponding receptive sockets 70, 72 on the other abutting pad guide the pads together and into proper lateral orientation with respect to each other. The inclined surfaces 74, 76 of the projections 66, 68 may be conical, as shown, or may take other configurations to effect the same function, that of bringing the legs 10, 12 into progressive lateral alignment in response to movement of the legs toward each other. In some instances it may be desirable to provide each pad with one projection and one socket which will mate with a corresponding socket and projection on the other abutting pad.

Further modifications may be made to the nut-holding chuck 42'. As shown in FIGS. 12–17, the lateral slot 48' may extend downwardly beyond the bottom of the longitudinal slot 78 to enhance slightly the flexibility of the upwardly extending finger 80 defined by the transverse slot 48' and which is intended to engage the backside of the earlobe. The enhanced flexibility of the finger 80 enables the width of the transverse slot 48' to be made sufficiently small so that it may effect a sufficient grip on the lateral flanges of the nut but will flex sufficiently to permit easy separation of the nut from the chuck 42' after the piercing operation has been completed. Removal of the nut from the chuck may be further enhanced by providing a chamfer on the portions 82 of the chuck as suggested in phantom at 84 in FIGS. 12 and 14.

A further modification may be made to the finger 80 as can be seen from FIGS. 12, 15 and 17. Here the depth of the longitudinal slot 78 in the finger 80 is just slightly below the axis of the pin so that the pin may just pass over the bottom of that portion 78' of the slot 78. Further, the width of the slot 78' in the finger 80 is less than the width of the portion 78 of the longitudinal slot so that it may be sufficiently wide to receive the pin without interference. By reducing the dimensions of the opening of the slot 78' in the finger portion 80, the chances of the skin at the rear surface of the earlobe being caught and pinched between the pin and the nut in the finger 80 is significantly reduced.

The embodiment shown in FIGS. 18 to 21 inclusive, is particularly designed for commercial production. A number of the structural features are common or similar in arrangement and function to those described in previously described embodiments and, in particular, to FIG. 12. The preferred unit includes legs 210 and 212 interconnected by bight 214. The upper end of the legs 210 and 212 form jaws 216 and 218. The barrel 224 is integrally formed with jaw 216. The barrel is preferably at least partially transparent so that the operator of the device can observe movement of the pin toward the earlobe. A chuck 242 is integrally formed with jaw 218. The U-shaped member may be formed with recessed portions on the faces of the legs to reduce the amount of material incorporated into the ear piercer.

The barrel 224 is formed with a boss 225 on its inner surface. This boss 225 is preferably an elongated projection with tapered ends 226. The boss 225 is designed to frictionally engage the sidewall of the head 228 of a pin with a friction fit of a force in the order of magnitude of one or two pounds. The barrel 224 and/or the boss 225 can be resiliently distorted or displaced to allow the pin to pass down the barrel when a force sufficient to overcome the frictional engagement is applied to the end of the pin.

Figure 20:
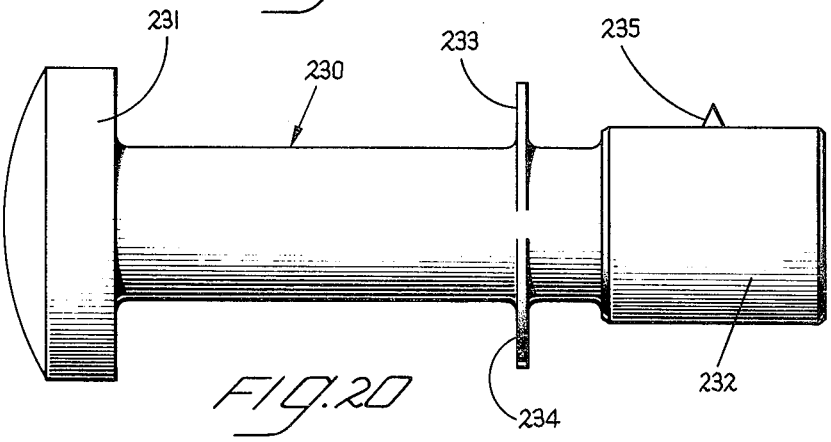
FIG. 20 is a side elevational view of the plunger used in the preferred embodiment of FIG. 18.

The plunger 230 includes enlarged knob 231 at one end (FIG. 20). The other end includes a ram 232 that abuts the head of the pin within the barrel when the plunger is in its normal position. The plunger 230 is maintained in a normal position by the frictional engagement of projection 235. Projection 235 is small, in the order of magnitude of 0.01", for a ram having a diameter of 0.165. This projection is designed to provide sufficient frictional interference to assure that plunger 230 will remain in barrel 224 when loaded, but will not interfere with the frictional movement of the plunger as hereinbefore described. Flanges or collars 233 and 234 extend radially from the plunger. These collars are positioned longitudinally in respect to the extreme end of ram 232 so that the engagement of collars 233 and 234 with the end 236 of barrel 224 will locate the extreme end of ram 232 adjacent the head of the pin secured by boss 225. The collars 233 are integral with the plunger and are dimensioned so that approximately 5 to 10 pounds, and preferably 9 pounds, of force exerted against the collars will cause them to shear off when the plunger is pushed into the barrel. It has been determined that greater control or uniformity may be attained by making collars as described.

The chuck 242 is designed to hold a nut lightly in position against inadvertent dislocation during handling and prior to shipment. The chuck includes a plurality of fingers 243A and 243B, and 244A and 244B. The legs are defined by orthogonally related slots 245 and 246. One side 246A of slot 246 is wider than side 246B so as to limit insertion of a nut in one position only as illustrated in dotted outline at 250. Legs 244A and 244B may be connected by a web 251 which extends preferably the depth of slot 246. An enlarged opening 247, extending across the chuck 242 at the bottom of slot 245 causes legs 243A and 243B to have a spring-like function. A cap 254 covers the web 251 and simulates a button. This cap is preferably grooved to provide a friction surface that is more readily engaged by the operator's finger. Jaws 216 and 218 respectively, are provided with facing and projecting lands 220 and 222. These lands are aligned and shaped to engage and thereby limit closing movement of the jaws. Bosses 268 and 260 on land 220 are aligned with complementary recesses 272 and 270 in land 222 to assist in properly aligning the jaws upon closing. Boss 260 is formed adjacent one side and boss 268 adjacent the other side of jaw 220.

Further modification may be made to the manner in which the pin and/or plunger are retained within the bore of the barrel in readiness for use. As an alternate to the ribs described previously, the surface of the barrel may be provided with a very slight projection, of the order of a few thousandths of an inch. This may be achieved by molding such projection directly onto the surface of the barrel bore or in some instances a slight projection may be achieved by merely scratching or blemishing the inner surface of the bore which may roughen it slightly. The blemishes should, of course, be located on the bore so that they will engage the pin and/or plunger respectively in a position ready for use.

One feature of the present invention comprises an arrangement for piercing an earlobe with a headed pin and securing the pointed end of the pin to a nut positioned on the side of the lobe opposite the pin. This arrangement includes a means for positioning the pin on one side of the lobe and the nut on the other. Means are provided for retaining the pin and nut in spaced relative positions against forces over a range from a first force to a second force of substantially greater magnitude than the first. Upon application of a force in excess of the second force the pin is abruptly released from its spaced relative position and is driven through the lobe and into engagement with the nut. Means are also provided for releasing both the pin and nut from the arrangement when in said engaged position. The specific means for abruptly releasing the pin may vary and may include such elements as a deformable or movable detent, although a frangible or breaking element such as the collar arrangement previously described is preferred. In preferred embodiments forces may be applied either directly to the pin or to means for applying forces to the pin in an order of magnitude less than said first force without driving the pin through the lobe.

The invention is particularly suited for low cost production and may be easily preassembled with the pin and nut and then be packaged in sterilized condition so that it may be ready for use immediately when desired. It avoids the need for separate preliminary sterilization steps and other procedures which have heretofore been an inherent part of the earlobe piercing surgical procedure. The self-destructing feature of the invention insures sterility in that once used the device cannot be reused.

It should be understood that the foregoing description of the invention is intended merely to be illustrative thereof, and that other modifications and embodiments may be apparent to those skilled in the art without departing from its spirit.

Figure 23:
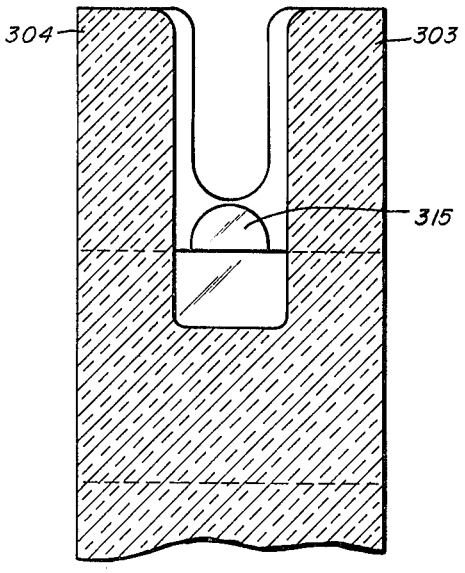
FIGS. 23 and 24 are, respectively, views taken of the lines 23—23 and 24—24 of FIG. 22.
Figure 24:
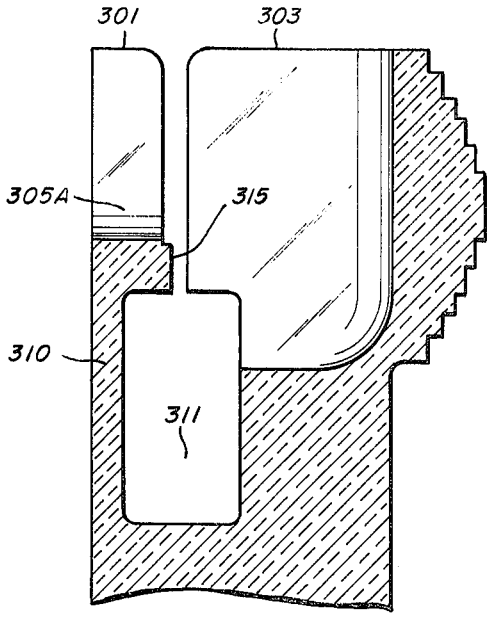
Figure 22:
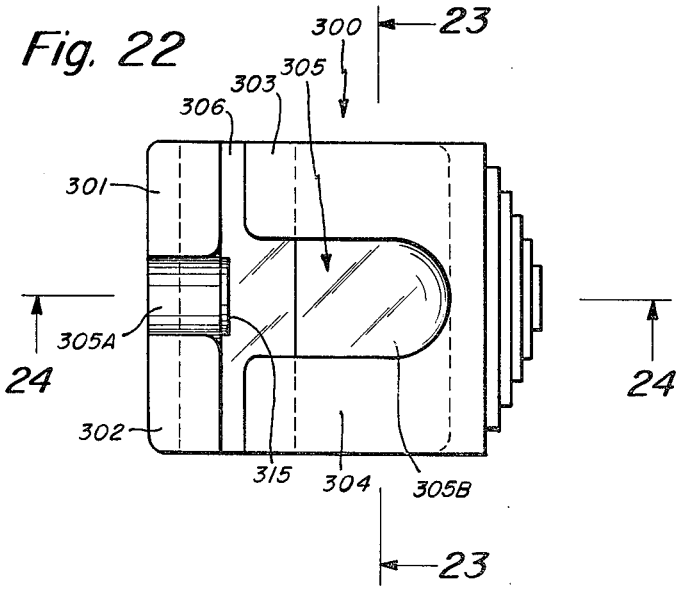
FIG. 22 is a top view of the preferred modificiation of the nut carrying jaw.

Referring specifically to FIGS. 22 through 24, there is illustrated a preferred modification of the nut carrying jaw. The chuck partially illustrated at 300 which is formed on this jaw is designed to hold a nut lightly in position against inadvertent dislocation during handling and prior to shipment. The chuck includes a plurality of upwardly extending parallel fingers 301, 302, 303 and 304 which define orthogonally related slots 305 and 306. One end, 305A of slot 305, is wider than the other end 305B so as to limit insertion of a nut to one position only. The nut is similar to that illustrated in dotted outline in FIG. 19 at 250. Legs 301 and 302 may be connected by a web 310. An enlarged opening 311 extending across the chuck 300 at the bottom of slot 306 causes legs 301 and 302 to have a spring like function. At the upper end of the web 310 there is formed a boss or button 315. This boss or button 315 projects into the slot 306. The purpose of this boss or button 315 is to exert pressure on the nut inserted in the slots 305, 306. The boss 315 is shaped and positioned to engage the nut as the nut is slid into the slots 305 and 306. The thickness of the wings of the nut is substantially the thickness of slot 306. Accordingly the button 315 is deflected outwardly as the nut is inserted in the slots, thereby frictionally engaging the nut and retaining it in the slots. The button or boss 315 engages one of the wings of the nut close to the opening of the nut in such a manner that the web 310 is not overstressed or takes a set which destroys the effectiveness of the spring tension. By using a boss or button 315 rather than making the entire surface of the legs 301 and 302 thicker, overstressing of the spring action or setting of the plastic is avoided. In addition manufacture and tooling for slot 306 is considerably improved.

Having thus described the invention, what I desire to claim and secure by Letters Patent is:

1. A piercing device comprising a pair of spaced jaws, means supporting said jaws for movement toward each other from a remote to a spaced proximate position;

means for limiting the proximity to which said jaws may be moved to provide a space between said jaws within which a member may be positioned;

piercing pin carrying means mounted to one of said jaws supporting a pin having a point at one end and a head at the other end with the longitudinal axis of said pin extending generally toward the other of said jaws;

a plunger carried by said pin carrying means in alignment with and adjacent to the head of said pin and mounted for movement toward said other jaw;

means operatively interengaging said plunger and said pin carrying means for moving said one jaw toward said other jaw to their proximate position in response to a force applied to said plunger in the direction of the other jaw;

means for disengaging said plunger and said pin carrying means when said jaws are in said proximate position and a force which is greater than that required to urge said jaws to their most proximate position is applied to said plunger, whereby upon disengaging of said plunger and said carrying means, said plunger will move forwardly under the influence of said greater force to drive said pin forwardly toward said other jaw.

2. A device as defined in claim 1 wherein said pin carrying means comprises;

a barrel having a bore extending through the barrel toward said other jaw, said bore having dimensions greater than the head of said pin to allow said pin to be moved through said bore toward said other jaw.

3. A device as defined in claim 2 wherein said plunger has a cross-section shaped to pass through said bore, and wherein said means operatively interengaging said plunger and pin carrying means comprises;

a collar secured to said plunger intermediate its ends and extending radially therefrom, said collar being engageable with one end of said barrel to limit insertion of one end of said plunger into said barrel to a predetermined position, said collar being fracturable in response to said greater force on said plunger.

4. A device as defined in claim 3 further comprising;

said plunger having a diameter at its juncture with said collar that is less than the diameter of said bore.

5. A device as defined in claim 2 wherein said means operatively interengaging said plunger and pin carrying means comprises;

projection means on the surface of the bore in obstructing relation to said pin, said projection means being fracturable when engaged by said pin as said pin is moved by said greater force.

6. A device as defined in claim 2 further comprising;

said bore of said barrel having dimensions conforming in shape to the dimensions of the head of said pin and retaining said pin in a slidable but snug fit.

7. A device as defined in claim 6 including at least one rib extending longitudinally of said bore, and engageable with said pin to effect said snug fit.

8. A device as defined in claim 7 wherein said one rib engages at least a portion of one end of said plunger when said one end of said plunger is disposed within said bore.

9. A device as set forth in claim 1 wherein said means for disengaging said plunger and said pin carrying means require said greater force to be of the order of approximately between two to five pounds greater than that required to urge said jaws to said proximate position.

10. A device as defined in claim 1 wherein said jaws are formed at the ends of a pair of legs, and a resilient spring member interconnecting the opposite ends of said legs to form a U-shaped configuration.

11. A device as defined in claim 10 further comprising means for maintaining lateral alignment of said jaws as said jaws are moved to said proximate position.

12. A device as defined in claim 11 wherein said means for limiting the proximity to which said jaws may be moved comprises a first abutting member on one of said legs and extending toward the other and a second abutting member on the other of said legs and extending toward said first abutting member, one of said abutting members having a convex configuration and the other of said abutting members having a concave configuration complementary and aligned with said convex configuration.

13. A device as defined in claim 12 further comprising;

said concave and convex configurations of said abutting members being V-shaped in cross-sectional configuration taken along a plane substantially normal to the longitudinal dimensions of said legs.

14. A device as defined in claim 12 further comprising;

said convex configuration of said one of said abutting members being defined by a pair of heightwise spaced projections, each of said projections having a side portion of conical configuration, the conical surfaces of said projections facing in transversely opposite directions, the other of said abutting members having receptive pockets formed therein and facing said projections, said pockets having complementary conical surfaces to receive said conical surfaces of said projections.

15. A device as defined in claim 1 including means defining a chuck for holding a nut on the other of said jaws with the nut oriented to receive the point of said pin when said pin is moved toward said other jaws, said chuck having slots for removal of said nut with said pin attached thereto.

16. A device as defined in claim 1 including chuck means for holding a nut designed to engage the point of said pin, and formed by a pair of orthogonally related slots extending longitudinally of and from the upper end of said jaw with one of said slots comprising a transverse slot intersecting said other slot, said transverse slot extending beyond the bottom of said other slot closer to one surface of said chuck to define a slightly flexible finger;

said one other slot having a depth sufficient to support said nut in alignment with said pin when said jaws of said device are in said proximate position, said fingers having a flexibility for facilitating separation of said nut from said chuck.

17. A device as defined in claim 16 wherein that portion of said other slot which extends through said finger has a bottom slightly below the axis of a piercing pin in said carrying means and is of a width slightly larger than a shaft of said piercing pin.

18. A device as defined in claim 16 wherein the open end of said one slot is beveled to define an enlarged exit area from said chuck.

19. A device as set forth in claim 1 wherein said means for disengaging includes an element which is suddenly deformed when said greater force is reached.

20. A device for piercing an earlobe with a pin having a point at one end and a head at the other end and for securing the pin to the earlobe with a nut engaging the pointed end of the pin comprising;

first means for commonly supporting the pin and nut for movement from first spaced relative position to an engaged position wherein the pin is engaged by the nut;

second means at least in part including the first means for guiding and limiting said pin and nut to a second spaced relative position closer together than said first spaced relative position with the pin point generally aligned with the nut under a force of up to a first magnitude;

plunger means for applying a force on the head of the pin in a direction toward said nut;

means for absorbing the force applied through said plunger means which is below said first magnitude to retain said pin and nut in said second position until a force greater than said force of said first magnitude is applied through said plunger means and for abruptly releasing at least one of said pin and nut for movement to said engaged position from said second spaced relative position when a force greater than said force of said magnitude is applied.

21. A device as set forth in claim 20 wherein said retaining means includes a rupturable member that is destroyed upon application of a force in excess of said first magnitude.

22. A device for piercing an earlobe with a pin having a head at one end and a point at the other end and for securing the pin to the earlobe with a nut engaging a pointed end of the pin comprising;

first means for commonly supporting the pin and nut for movement from a first spaced relative position to an engaged position wherein the pin is engaged by the nut;

second means at least in part including the first means for guiding said pin and nut to a second spaced relative position closer together than said first spaced relative position under a force of up to a first magnitude;

means for limiting the force which can be applied to an earlobe positioned between said pin and nut when said pin and nut are moved to said second spaced relative position.

means for limiting at all times the force which can be directly applied to the head of said pin as said pin and nut are moved from said first to said second spaced relative positions to one which is less than said first magnitude and for maintaining the same relative location to one another of said pin and said second means as said pin is moved from said first to said second spaced relative position;

and means for moving said pin and nut from said second spaced relative position to said engaged position when a force greater than said first magnitude is applied.

23. A device for piercing an earlobe with a pin having a head at one end and a point at the other end and for securing the pin to the earlobe with a nut engaging a pointed end of the pin comprising;

first means for commonly supporting the pin and nut for a movement from a first spaced relative position to an engaged position wherein the pin is engaged by the nut;

second means at least in part including the first means for guiding said pin and nut to a second spaced relative position closer together than said first spaced relative position under a force of up to a first magnitude;

means for limiting at all times the force which can be directly applied to the head of said pin as said pin and nut are moved from said first to said second spaced relative position relative positions to one which is less than said first magnitude; said means for limiting including a rupturable member that is destroyed upon application of a force in an excess of said first magnitude, and means for moving said pin and nut from said second spaced relative position to said engaged position when a force greater than said first magnitude is applied.

24. A device for piercing an earlobe with a headed pin and securing the pin to a nut comprising;

common means for supporting a pin and nut for movement from a more remote to a closer spaced relative position, said pin having a head at one end and a point at the other end with the pointed end of said pin on one side of an earlobe and said nut on the other side of said earlobe, said common means including means to limit movement toward each other of said point and nut to said closer spaced relative position and to limit the force that may be applied to an earlobe between said pin and nut in said closer spaced relative position, plunger means supported by said common means with one end adapted to engage the headed pin and upon application of a hand force at the other end in excess of a preselected amount applied directly to the head of said pin to drive the point of said pin from said closer spaced relative position through said earlobe into engagement with said nut, means for preventing the movement of said pin from said closer spaced relative position upon application of forces below said preselected amount including means for abruptly releasing said pin for movement when said preselected force is exceeded.

25. A device as set forth in claim 24 wherein means are provided for moving said pin and nut to said spaced relative position from a position more remote, upon application of a force below said preselected amount to portions of said common means.

26. A device for piercing in earlobe with a headed pin and nut adapted for a single use comprising;

common means for removably retaining a nut and a pin having a head at one end and a point at the other in spaced array with said nut on one side and said pin on the opposite side of an earlobe;

and means for driving the point of said pin through said earlobe into engagement with said nut including deformable means operatively inter-engaging with said means for driving for limiting movement of said means for driving until the force sufficient to deform said deformable means is exceeded and for directly transferring said force to said pin whereby said pin is driven from said position of spaced alignment through said earlobe, and said device is not reusable after said deformable means is deformed.

27. A device as set forth in claim 26 wherein said means for deforming includes a collar integral with and extending laterally from said driving means.

28. A device for piercing an earlobe in combination with a headed pin and nut adapted for single use comprising;

an integrally formed unitary means for commonly and removably retaining a pin having a head at one end and a point at the other and nut with the pin and nut normally retained in spaced array with the space therebetween of sufficient width to receive an earlobe, said unitary means adapted to be deflected from a normal to a second position in gripping relation with an earlobe between said pin and nut and with said pin and nut in spaced relation; means for limiting at all times the force which can be directly applied to the head of said pin as said unitary means is moved to said second position; means for limiting the force which can be applied to an earlobe positioned between said pin and nut when said unitary means is moved to said second position; a plunger, said unitary means also providing means to receive the end of a plunger, said plunger comprising a single element positioned in said unitary means with one end engageable with said pin and the other end adapted to be engaged and operated by hand pressure, whereby application of pressure on said plunger will drive said pin from said position of spaced relation into said nut.

29. A device as set forth in claim 28 including:

means for permitting movement of said unitary means from said normal to said second position upon initial application of said hand pressure, and means for maintaining said unitary means in said second position while said hand pressure is maintained below a preselected force, said means for maintaining said unitary means in said second position, also maintaining said pin and nut in spaced relation until said hand pressure exceeds said preselected force whereupon said pin is driven into said nut.

30. A device as set forth in claim 29 wherein said means for permitting movement includes means extending from one of said plunger and the plunger receiving means of said unitary means into interfering relation with the other of said plunger and said plunger receiving means, and with at least one of said means for permitting movement and the means engaged thereby adapted to be deformed to permit relative movement of said plunger and said plunger receiving means when said hand pressure exceeds said preselected force.

31. A device as set forth in claim 30 wherein said means for permitting movement comprises a collar extending from said plunger and adapted to engage the plunger receiving portion of said unitary means.

32. In a device for piercing an earlobe having a means for commonly supporting a headed pin and nut in spaced relation to one another and means for supporting a plunger in alignment with said pin, a plunger, said plunger comprising an elongated member having one end adapted to engage the head of a pin and the other adapted to receive hand pressure, and means extending from said elongated member for restraining movement of said elongated member in said supporting means until a force of a predesigned magnitude sufficient to drive said pin through an earlobe is exceeded, whereupon said extending means is deformed and said force is transmitted directly through said elongated member against said pin whereby said pin may be driven through said earlobe.

33. A device as set forth in claim 32 wherein said extending means comprises a collar radially extending from said elongated member and adapted to be sheared therefrom on movement of said plunger in said plunger supporting means.

34. A piercing device for an earlobe including a U-shaped member having a pair of legs extending from the bight of the U, said bight resiliently maintaining said legs in first spaced unstressed relation to one another for pivotal movement from said first spaced relation towards one another, means for supporting on one leg a pin having a head at one end and a point at the other, said means for supporting said headed pin being adapted to normally maintain the point of said pin projecting therefrom in a direction towards said nut whereby said pin will be in pressure engagement with but not pierce an earlobe when said legs are in engagement with said earlobe prior to driving said driving means, means for supporting a nut having an opening to receive said pin on the other leg, means for limiting the movement of said legs towards one another against the resilience of said bight whereby the point of said pin and said nut are spaced apart a distance sufficient to accommodate an earlobe with said one leg adapted to engage one side of an earlobe and the other leg adapted to engage the other side, and means for driving the point of said headed pin through an earlobe into engagement with said nut from said position in which said legs engage the earlobe.

35. A device as set forth in claim 34 wherein said means for supporting said headed pin comprises a barrel having an axially extending bore in which said pin is located and said means for driving said pin includes a plunger aligned with said pin and positioned partially within said bore, said plunger having one end external of said bore and shaped to receive a force in direction toward said pin;

interfering means extending from one of said plunger and said U-shaped member into interfering relation with the other of said plunger and said U-shaped member when said force below a preselected amount is applied to said plunger whereby said legs may be moved to said limited position, said interfering means further shaped to permit relative movement of said plunger and barrel only when said force exceeds said preselected amount whereby said pin is driven from said barrel through an earlobe into engagement with said nut.

36. A device as set forth in claim 35 wherein said interfering means includes a collar extending from said plunger adapted to engage said U-shaped member and be sheared upon application of forces exceeding said preselected amount.

37. A device for piercing earlobes with a headed pin comprising;

a unitary means formed of light transmitting material having one portion shaped for receiving and removably retaining a headed pin, and a second portion normally in spaced alignment from said one portion with the space therebetween of sufficient width to readily receive an earlobe;

means for deflecting said portions from said normal spaced alignment to a second position wherein said one portion is adapted to be positioned on one side of and said second portion is adapted to be positioned on the other side of and in gripping engagement with an earlobe, and when in said gripping engagement said pin and its spacial relation to said one portion and to the earlobe is visible through said light transmitting material of said one portion;

and means for driving said pin when the unitary means is in said gripping engagement through an earlobe gripped thereby.

38. A method of earlobe piercing comprising;

aligning a headed pin on one side and a nut to receive and secure the pin on the other side of an earlobe;

axially moving the pin into pressure engagement with the earlobe without piercing the skin and at substantially the said time securing the earlobe skin in a circumference about the point of contact of said pin relative to said nut, and thereafter accelerating the pin in a direction toward said nut whereby said earlobe is suddenly pierced and said pin is interlocked with said nut.

39. A device for piercing an earlobe with a pin comprising;

first means for supporting a pin having a head at one end and a point at the other end, said first means adapted to be positioned on one side of an earlobe and second means adapted to be positioned on the other side, common means for supporting said first and second means in first spaced relative position;

a plunger with one end adapted to engage said headed pin and upon application of a force in excess of a preselected amount to drive said pin from said first means with its point through an earlobe positioned between said first and second means;

means for absorbing forces below said preselected amount only in said first means, thereby preventing the movement of said pin from said first means upon applications of forces below said preselected amount;

said means for absorbing forces including means for abruptly transferring said forces to said pin for said movement when said preselected force is exceeded;

said first means including a barrel having a bore therein to receive said plunger and headed pin in longitudinal alignment;

and means providing a frictional interengagement between said barrel and said plunger including members integrally formed with at least one of said barrel and plunger and extending into interfering fit with the other of said barrel and plunger.

40. A device of claim 39 wherein said means providing frictional interengagement comprise a boss means formed on the surface of the bore of said barrel also to frictionally engage the head of said pin.

41. The device of claim 40 wherein said boss means extends longitudinally along the bore of the barrel and has tapered ends.

42. The device of claim 39 wherein said plunger has a projection frictionally engaging the bore of said barrel.

43. The device of claim 39 wherein said plunger has a collar extending radially therefrom for limiting movement of the plunger in the barrel until said preselected force is exceeded in which case said collar is sheared from the plunger.

44. The device of claim 39 wherein at least a portion of said barrel is transparent whereby movement of the end of said pin may be seen as the pin is moved toward and in contact with the earlobe.

45. The device of claim 39 including said second means having portions supporting a nut to receive the end of said pin after said pin has pierced the earlobe.

46. A device as set forth in claim 45 wherein said second means comprises a chuck defined by orthogonally arranged slots extending from an end of said second means within which slots portions of said nut are removably secured, said slots arranged with an enlarged opening whereby the fingers defined by said slots exhibit a spring action to resiliently secure said nut therein, one of said slots being wider along at least a part of its length than the other, whereby a nut having portions shaped to closely fit in one pair of said slots cannot be oriented to fit in the other pair of said slots.

47. A device as set forth in claim 46 wherein a web extends across one end of said wider slot.

48. A device as set forth in claim 39 wherein said device is formed of a transparent plastic with sidewalls of said common means having reinforcing ribs.

49. A device as set forth in claim 39 wherein said common means includes abutting pads projecting toward one another in spaced alignment when said common means is in an unstressed position, said abutting pads adapted to be interengaged upon application of a force on said common means to limit movement of said first and second means to said first spaced relative position.

50. A device as set forth in claim 49 wherein projections are formed on each of said abutting pads in alignment with corresponding recesses on the other of said pads whereby said pads are maintained in alignment when moved toward one another.

51. A plunger for use in an earlobe piercing apparatus wherein said plunger is designed for driving a pin through an ear, comprising an enlarged terminal portion terminating axially in a first pin-engaging end for abutting a head of a pin, an axially opposite thumb-engaging end for abutting a thumb of a user, an intermediate shaft between the thumb-engaging end and the enlarged terminal portion, and stop-engaging means on the shaft operatively engageable with a stop to prevent application of forces on said pin until a force on the thumb-engaging end exceeds a force of a given magnitude whereupon the stop engaging means is suddenly disengaged and forces applied to said plunger are transferred to said pin.

52. The earlobe piercing apparatus of claim 51 wherein the stop engaging means comprises a thin sheet fixed to and radially extending from said shaft, and adapted to engage a support means for said pin.

53. An earlobe piercing apparatus as set forth in claim 53 wherein said sheet has a thickness such that it is sheared from said shaft when forced against support means with a force in excess of said given force.

54. The earlobe piercing apparatus of claim 51 further comprising a barrel having a stop and means for receiving and radially surrounding the enlarged terminal portion to hold the plunger with the stop-engaging means against said stop, and with a portion of the shaft and the thumb-engaging end protruding from the barrel.

55. The earlobe piercing apparatus of claim 54 wherein the stop comprises a first axial end of the barrel, and wherein the stop-engaging means comprises a thin, rigid sheet fixed to the shaft and radially extended therefrom and axially overlying the first axial end of the barrel.

56. In an earlobe piercing apparatus, in combination a pin having a cylindrical head at one end of a coaxial shaft and a barrel having an axial bore for receiving said pin with its head entirely contained in but with its shaft only substantially contained in said barrel, said barrel having at least a portion thereof at the end from which said pin projects being transparent for viewing said pin and an earlobe area through said transparent portion, said pin in sliding engagement with said barrel, and a plunger extending into said barrel and having an end abutting said head, said barrel also having a stop for holding said plunger temporarily against axial movement.

57. In an earlobe piercing apparatus the arrangement comprising a barrel having a bore, an ear stud mounted within the barrel, the ear stud having a head portion mounted within the bore and having a shaft portion substantially contained within said barrel and extending forward from the head portion through the bore and out of the barrel and terminating in a point extending axially outward from the transparent barrel a distance of substantially 1/16th of an inch.

58. In an earlobe piercing apparatus a support for an ear stud lock nut comprising a base and four spaced fingers fixed to the base and extending upward therefrom in first inner and second outer pairs in generally parallel relationship, said fingers of the first inner pair being spaced apart by a relatively narrow gap, and said fingers of the second, outer pair being spaced apart by a relatively wide gap to receive a portion of said nut with said nut capable of being secured within said support in one position only.

59. The earlobe piercing apparatus of claim 58 wherein fingers of the first, inner pair are joined to the base by a thin spring portion whereby the nut is held resiliently between the first and second pairs of fingers.

60. Earlobe piercing apparatus comprising a pair of jaws for holding respectively an ear stud and stud lock, joining means connected to the jaws and supporting the jaws for relative inward and outward reciprocal movement and spacer means connected to the joining means limiting proximity of the jaws and directional-stabilizing means formed in the surface of this spacer means for constraining the jaws to a predetermined path when the jaws are moved toward a firing position, said spacer means further comprising first and second abutting pads having abutting faces with projections formed thereon, and said directional-stabilizing means comprising recesses on said abutting faces complementary to said projections and on opposite abutting faces for respectively receiving said projections.

* * * * *